US010161719B2

(12) United States Patent
Burgaleta Sanchez et al.

(10) Patent No.: US 10,161,719 B2
(45) Date of Patent: Dec. 25, 2018

(54) VIEWFINDER FOR BOW STRINGS

(71) Applicants: IACTUM 2011, S.L., Navarra (ES); VITALARCHERY, S.L., Navarra (ES)

(72) Inventors: Jorge Burgaleta Sanchez, Navarra (ES); David Asin Sanchez, Navarra (ES)

(73) Assignees: IACTUM 2011, S.L. (ES); VITALARCHERY, S.L. (ES)

( * ) Notice: Subject to any disclaimer, the term of this patent is extended or adjusted under 35 U.S.C. 154(b) by 146 days.

(21) Appl. No.: 15/468,963

(22) Filed: Mar. 24, 2017

(65) Prior Publication Data

US 2018/0066919 A1 Mar. 8, 2018

(51) Int. Cl.
*F41G 1/467* (2006.01)
*F41B 5/14* (2006.01)

(52) U.S. Cl.
CPC ..... *F41G 1/467* (2013.01); *F41B 5/1419* (2013.01)

(58) Field of Classification Search
CPC ..... F41B 5/1419; F41G 1/467
USPC ..... 33/265
See application file for complete search history.

(56) References Cited

U.S. PATENT DOCUMENTS 4,011,853 A 3/1977 Fletcher
4,833,786 A * 5/1989 Shores, Sr. ..... F41G 1/467 33/265
4,965,938 A * 10/1990 Saunders ..... F41G 1/467 124/87
5,137,007 A * 8/1992 Shoemake ..... F41G 1/467 124/87
5,669,146 A * 9/1997 Beutler ..... F41G 1/467 124/87
5,697,357 A * 12/1997 Chipman ..... F41G 1/467 124/87
6,058,921 A * 5/2000 Lawrence ..... F41G 1/467 124/87
8,201,339 B1 * 6/2012 Walker ..... F41G 1/467 124/87
2006/0101658 A1 * 5/2006 Chipman ..... F41G 1/467 33/265
2007/0119060 A1 * 5/2007 Grace, Jr. ..... F41G 1/467 33/265
2008/0066328 A1 3/2008 Bohn
2011/0186028 A1 8/2011 VandeWater
2012/0137529 A1 * 6/2012 Minica ..... F41G 1/08 33/265
2013/0081292 A1 * 4/2013 LoRocco ..... F41G 1/467 33/265
2015/0338190 A1 * 11/2015 Johnson ..... F41B 5/1419 33/265
2016/0169613 A1 * 6/2016 Wolf ..... F41B 5/1419 124/87
2017/0082401 A1 * 3/2017 Wolf ..... F41B 5/1419
2018/0066919 A1 * 3/2018 Burgaleta Sanchez ..... F41B 5/1419

(Continued)

*Primary Examiner* — Yaritza Guadalupe
(74) *Attorney, Agent, or Firm* — Hayes Soloway PC

(57) ABSTRACT

Viewfinder for bow strings, aimed to be connected to a bow string such that a user may look through it and obtain a precise shot, which comprises an elongated body with a through-hole defined between a front side and a rear side, wherein the hole further comprises a first sector, a second sector and a third sector, designed to prevent the reflections produced inside the hole by the light beams hitting it from the exterior from propagating to the user.

9 Claims, 4 Drawing Sheets

(56) References Cited

U.S. PATENT DOCUMENTS

2018/0087874 A1* 3/2018 Wolf ..... F41B 5/1419
2018/0112950 A1* 4/2018 Munsell ..... F41B 5/1419

* cited by examiner

VIEWFINDER FOR BOW STRINGS

OBJECT OF THE INVENTION

The present invention is framed within the technical field of details and accessories for bows, as well as sight devices for archery, and, in particular, relates to a viewfinder designed to be connected to a bow string in order to obtain a precise shot.

BACKGROUND OF THE INVENTION

Within the field of bow hunting and archery, a peep, clarifier or diopter is understood to be a viewfinder connected to the bow string, which is aligned with the main viewer of the bow frame, generally located at the junction between the two branches, in order to achieve a very precise shot.

In general, viewfinders consist of a disc or a cylinder with a central opening in the shape of a through-hole between the ends of the cylinder, and channels defined in an exterior framework which allow for connection to the string. As already specified, the central opening of the viewfinder must be aligned with the viewer of the bow in order to achieve a precise shot on target. Thus, the first limitation of current viewfinders arises from the fact that their alignment capacity is limited by the size of the opening.

On the other hand, due to the need to open the bow prior to shooting, the string tends to rotate. Said rotation of the string also produces a rotation of the viewfinder attached thereto, which displaces an inner circle of said viewfinder and causes that, when looking through it, an oval, rather than a circular, figure is observed; this leads to centring and, therefore, shooting errors.

Moreover, since the viewfinder is habitually equipped with only two trails defined on the lateral surface thereof, which are designed to house the bow string and thus connect both elements to one another, it is not completely fixed in the correct position and may undergo displacements during the hunting or the shooting due to abrupt blows or movements, thereby misadjusting the previous centring of the viewfinder performed during the installation thereof.

Moreover, during the practice of outdoor hunting or shooting, in general there is direct incidence of sunlight on the viewfinder, on both the front and the rear parts, with the consequent production of reflections inside the viewfinder which hinder the correct viewing of the central circle that indicates the correct centring, thereby also causing shooting errors.

DESCRIPTION OF THE INVENTION

The object of the invention consists of a viewfinder which, due to its special characteristics, prevents most of the problems and disadvantages described above. To this end, in order to prevent the problem of the sparkles and glares produced inside the viewfinder due to the light that enters through the front and/or the rear opening thereof, the through-hole that allows for vision through the viewfinder is divided into at least three sectors, said three sectors being two end sectors and one inner sector.

Each of the end sectors of the hole comprises a reduction, preferably of a concentric conical type, which starts from each of the ends towards the interior and gives them a geometry that is essentially that of a truncated cone. In a preferred embodiment, said concentric conical reduction is 20°, such that, even if, due to the rotation of the string around its own axis, the viewfinder rotates a maximum of 20°, vision through the hole continues to be a circular geometry not deformed by said rotation, which makes it possible to aim correctly.

The inner sector is defined, in the first place, by the respective inner ends of the end sectors and extends beyond said ends, which leads to an essentially annular geometry that isolates the sparkles and reflections produced, thereby preventing the light beams from directly hitting surfaces that may cause reflections in the eye of the user.

On the other hand, the central through-hole that allows for vision through the viewfinder, and which in general has a cylindrical geometry, comprises a reduction, preferably a concentric conical reduction, that starts from each of the ends towards the inner ring. In a preferred embodiment, said concentric conical reduction is 20°, such that, even if, due to the rotation of the string around its own axis, the viewfinder rotates a maximum of 20°, the central hole continues to be seen with a round geometry, not deformed by the rotation, which makes it possible to aim correctly.

Moreover, a roof- or hood-type body is incorporated into at least one of the holes of the viewfinder, preferably the one opposite to that where the eye of the user is placed, in order to further reduce the possible entry of light beams that may hit the hole from above, since these are the main causes of reflections.

The outer lateral surface of the viewfinder comprises a plurality of channels or grooves that allow for fastening to the bow string. A central groove, concentric with respect to the central axis of the viewfinder, serves to transversally tie it to the string, whereas a set of lateral grooves prevent said viewfinder from sliding around the string. In a preferred embodiment, the lateral grooves are inclined 37° with respect to a horizontal plane, which makes it possible that, when the string is opened, the central hole viewed through the viewfinder is perpendicular to said horizontal plane.

In the case of viewfinders used for beginner users, there is the option to incorporate a projection that makes it possible to connect them to the end of a rubber band which, in turn, is connected to the bow on the other end, the purpose whereof is to help to straighten the viewfinder when the bow is opened, since the rubber band exerts a force on said viewfinder, by pulling forward.

The viewfinder thus described is connected to the bow string by housing it in its central and lateral grooves. Once it is secured, when the string is stretched prior to a shot, the user looks through the hole of the viewfinder and aligns said central hole with the viewer of the bow and the target, thereby obtaining a precise trajectory for the arrow or the projectile being shot.

DESCRIPTION OF THE DRAWINGS

In order to supplement the description being made, and to contribute to a better understanding of the characteristics of the invention, according to a preferred embodiment thereof, a set of drawings is attached to said description as an integral part thereof, where the following is represented for illustrative, non-limiting purposes.

PREFERRED EMBODIMENT OF THE INVENTION

With the aid of the aforementioned figures, below we provide a detailed description of a preferred embodiment of the object of the present invention.

Figure 1:
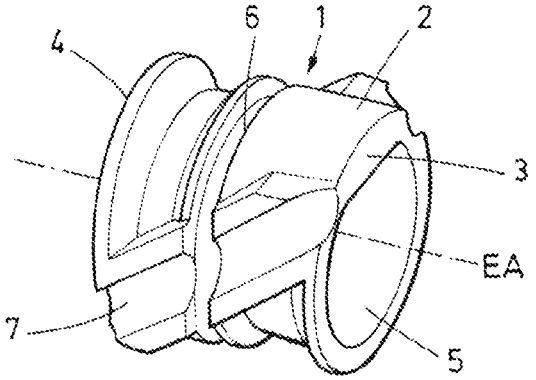
FIG. 1.—Shows a lateral perspective view of the front part of the viewfinder, wherein its main constituent elements may be observed.
Figure 2:
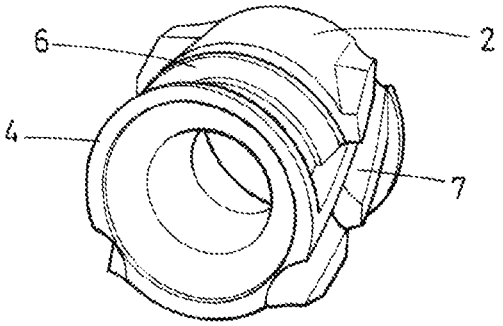
FIG. 2.—Shows a perspective view of the rear part of the viewfinder.
Figure 3:
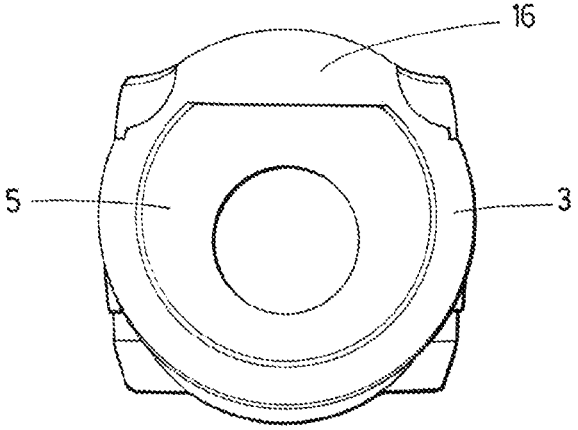
FIG. 3.—Shows a front view of the viewfinder.
Figure 4:
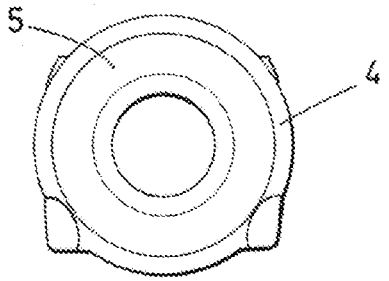
FIG. 4.—Shows a rear view of the viewfinder.
Figure 5:
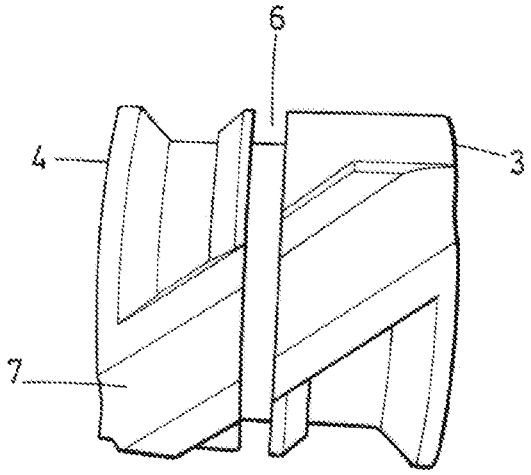
FIG. 5.—Shows a lateral view of the viewfinder.

The viewfinder for bow strings being described, shown in FIGS. 1 and 2, is composed of an elongated body (1) which, in the embodiment described herein, has an essentially cylindrical geometry, and is preferably made of a light, resistant material, such as aluminium or plastic, the body (1) being defined by an axial axis (EA), an outer lateral surface (2), a front side (3) and a rear side (4). The body (1) has a through-hole defined between the front side (3) and the rear side (4), which, as may be observed in the attached figures, is co-axial with respect to the axial axis (EA) of the body (1). Said hole is defined by an inner lateral surface (5) of the body (1).

In the viewfinder thus defined, the users bring their eye close to the rear side (4), in order to look through the hole and align said hole with a viewer placed in the bow, thereby achieving a precise shot on target.

As observed in the aforementioned figures, on the outer lateral surface (2) there is a first groove (6), concentrically located with respect to the axial axis (EA) and the hole of the body (1), which is designed to house the bow string, the latter being transversally tied thereto.

Moreover, the outer lateral surface (2) of the cylinder (1) incorporates a pair of second lateral grooves (7), defined on the two opposite sides of said outer lateral surface (2), which are designed to prevent sliding along the bow string. In the preferred embodiment described herein, said second grooves (7) have an inclination of 37° with respect to the axial axis (EA), which makes it possible that, once the bow has been opened, the hole is perpendicular to a horizontal plane.

Figure 6:
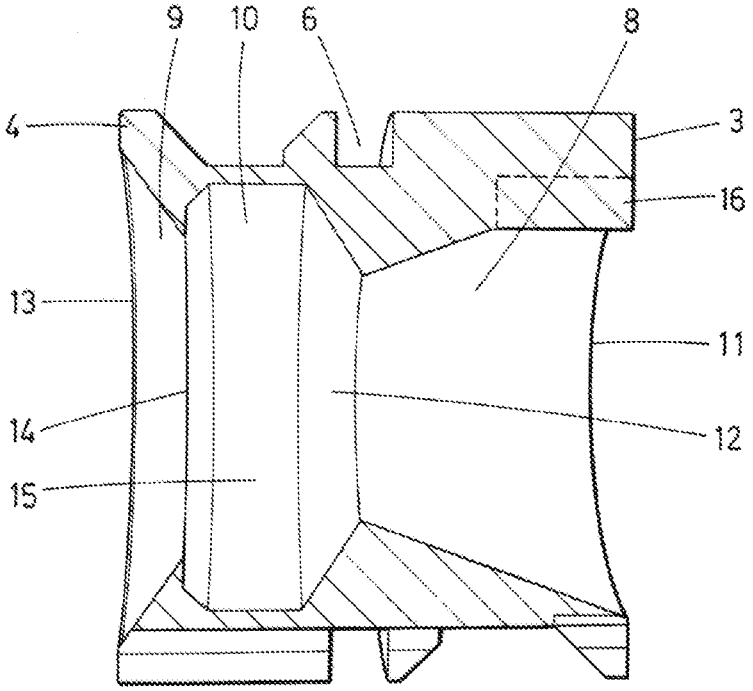
FIG. 6.—Shows a lateral view of a longitudinal cross-section of the viewfinder.
Figure 7:
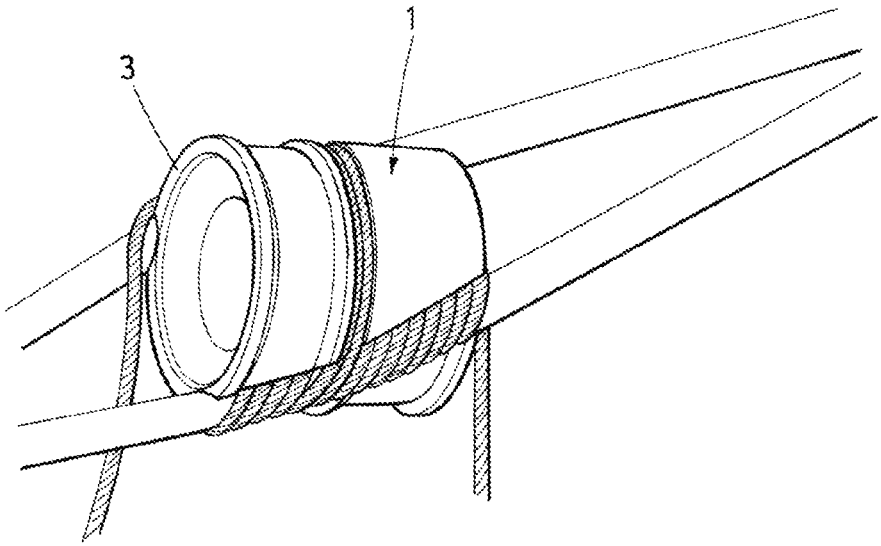
FIG. 7.—Shows a perspective view of the viewfinder connected to a bow string.

In order to prevent the light beams that penetrate into the viewfinder from directly hitting the inner lateral surface (5) of the hole, thereby causing reflections and other types of discomfort in the eye of the user that may lead to shooting errors, the hole comprises a first sector (8), a second sector (9) and a third sector (10), as shown in FIG. 6, which represents the embodiment wherein the first (8), the second (9) and the third sectors (10) are co-axial.

The first sector (8) of the hole originates from the front side (3) of the body (1), wherein the first end (11) is located, and extends longitudinally towards the interior, to a second end (12) that has smaller dimensions than those of said first end (11). In this preferred embodiment, the first sector (8) has the geometry of a truncated cone, arising from a concentric conical reduction that goes from the first end (11) to the second end (12).

On the other hand, the second sector (9) of the hole originates from the rear side (4) of the body (1), wherein a third end (13) of the second sector (9) is located, which extends longitudinally towards the interior, to a fourth end (14) that has smaller dimensions than those of the third end (13). As in the case of the third sector (8), this second sector (9) has the geometry of a truncated cone, due to a concentric conical reduction that goes from the third end (13) to the fourth end (14).

Finally, the third sector (10) of the hole is laterally limited by the second end (12) of the first sector (8) and the fourth end (14) of the second sector (9), and comprises a lateral surface (15) the dimensions whereof are greater than those of the second end (12) and the fourth end (14), albeit, obviously, without coming in contact with the outer lateral surface (2) of the body (1). As observed in the aforementioned FIG. 6, the third sector (10) of the preferred embodiment has an annular geometry.

Moreover, a shadow casting body (16) is to be incorporated on the upper portion of the front side (3) of the body (1), in order to further reduce the entry of sun rays that may hit the inner lateral surface (5) of the hole from above, which is the main cause of glares.

Figure 8:
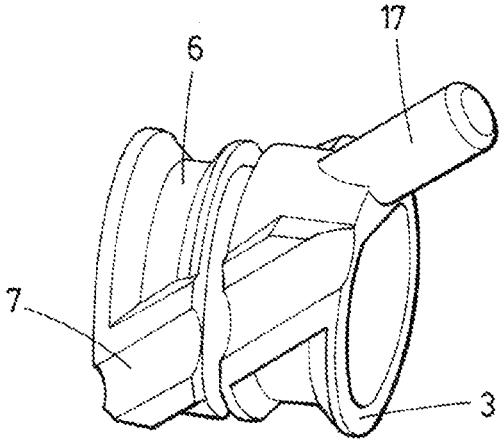
FIG. 8.—Shows a lateral perspective view of the front part of a viewfinder according to an embodiment that incorporates an additional extension.

In an alternative embodiment, the cylinder (1) incorporates a projection (17) projected outwardly from the outer lateral surface (2), as shown in FIG. 8. This projection (17) is designed to be connected to a rubber band, not represented in the attached figures, which contributes to adequately positioning and centring the viewfinder once it is joined to the bow string, this accessory being habitually used in the practice of archery for beginners.

Figure 9:
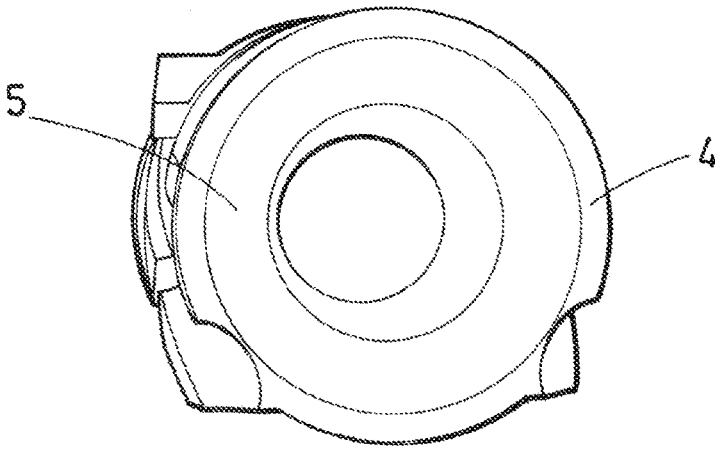
FIG. 9.—Shows a front view of the viewfinder in a rotated position.

The combination of the reductions of the first sector (8) and the second sector (9), jointly with the widening or hollowing out of the third sector (10), allows, in the first place, for viewing a target through a circular geometry, even if the viewfinder is displaced due to the rotations produced in the string to which it is connected; this, as observed in FIG. 9, facilitates a correct centring, and, consequently, a more precise shot. In the second place, the third sector (10) collects and isolates the reflections produced by the sun rays that penetrate inside the hole, thereby preventing glares and other types of discomfort.

The invention claimed is:

1. Viewfinder for bow strings, designed to be connected to a bow string such that a user may look through it and obtain a precise shot, which comprises an elongated body in the direction of an axial axis (EA), wherein said body, in turn, comprises:

an outer lateral surface, a front side, aimed to be oriented towards a target, a rear side, opposite to the front side, aimed to be oriented towards a user, a through-hole between the front side and the rear side, defined by an inner lateral surface of the cylinder, and a first groove defined on the outer lateral surface of the cylinder, co-axial with respect to the axial axis (EA), which is aimed to house the bow string, wherein the through-hole of the viewfinder further comprises:

a first sector that originates from the front side and comprises a first end, located on said front side, and a second, innermost end in the longitudinal direction, wherein the dimensions of the second end are smaller than those of the first end, a second sector that originates from the rear side and comprises a third end, located on said rear side, and a fourth, innermost end in the longitudinal direction, wherein the dimensions of the fourth end are smaller than those of the third end, and a third sector which is limited, respectively, by the second end of the first sector and the fourth end of the second sector, wherein the third sector comprises a lateral surface the dimensions whereof are greater than those of the second end and the fourth end, in order to prevent the reflections produced inside the hole by the light beams hitting it from the exterior from propagating to the user.

2. Viewfinder for bow strings according to claim 1, wherein the first sector, the second sector and the third sector of the hole are co-axial.

3. Viewfinder for bow strings according to claim 1, wherein the first sector of the hole has the shape of a truncated cone.

4. Viewfinder for bow strings according to claim 1, wherein the second sector of the hole has the shape of a truncated cone.

5. Viewfinder for bow strings according to claim 1, wherein the third sector of the hole has an annular geometry.

6. Viewfinder for bow strings according to claim 1, wherein it further incorporates at least a second groove defined on the outer lateral surface of the cylinder, which is aimed to house the bow string.

7. Viewfinder for bow strings according to claim 6, wherein the orientation of the second groove is not perpendicular to the axial axis (EA) of the cylinder.

8. Viewfinder for bow strings according to claim 1, wherein it further incorporates a shadow casting body, to further reduce the entry of light beams inside the hole.

9. Viewfinder for bow strings according to claim 8, wherein the shadow casting body is located on the upper portion of the front side of the body, in order to prevent the entry of light beams that may hit the interior of the hole from above.

* * * * *